United States Patent [19]

Dauvergne

[11] 4,240,784

[45] Dec. 23, 1980

[54] THREE-STAGE LIQUID FUEL BURNER

[76] Inventor: Hector A. Dauvergne, P.O. Box 884, San Leandro, Calif. 94577

[21] Appl. No.: 945,228

[22] Filed: Sep. 25, 1978

[51] Int. Cl.[3] ..... F23D 15/00

[52] U.S. Cl. ..... 431/351; 239/427.3

[58] Field of Search ..... 431/351, 352, 354; 239/427.3, 427.5

[56] References Cited

U.S. PATENT DOCUMENTS

| | | | |
|---|---|---|---|
| 1,069,243 | 8/1913 | Fogler | 239/427.3 X |
| 1,405,100 | 1/1922 | Cornwell et al. | 239/427,3 |
| 3,228,451 | 1/1966 | Fraser et al. | 431/352 X |

FOREIGN PATENT DOCUMENTS

| | | | |
|---|---|---|---|
| 141020 | 5/1951 | Australia | 239/427.3 |
| 466097 | 6/1950 | Canada | 239/427.3 |
| 543003 | 2/1932 | Fed. Rep. of Germany | 239/427.5 |

*Primary Examiner*—Robert S. Ward, Jr.
*Attorney, Agent, or Firm*—Bielen and Peterson

[57] ABSTRACT

A three-stage liquid fuel burner designed to combust fuel efficiently at a temperature less than 2600° F. to substantially inhibit fixation of polluting nitrogen compounds, the burner including three concentric cylindrical chambers of increasing diameter and staggered length, with provision for gradual introduction of air longitudinally through the chambers for full stoichiometric combustion, fuel being injected into the innermost chamber with air supplied below stoichiometric proportion for in complete combustion, the partially combusted gases passing longitudinally to a secondary outer chamber where air is supplied to approximately stoichiometric proportion, the relatively fully combusted gases passing longitudinally to a tertiary outermost chamber where air is supplied to nearly twice stoichiometric proportion.

10 Claims, 5 Drawing Figures

FIG-4
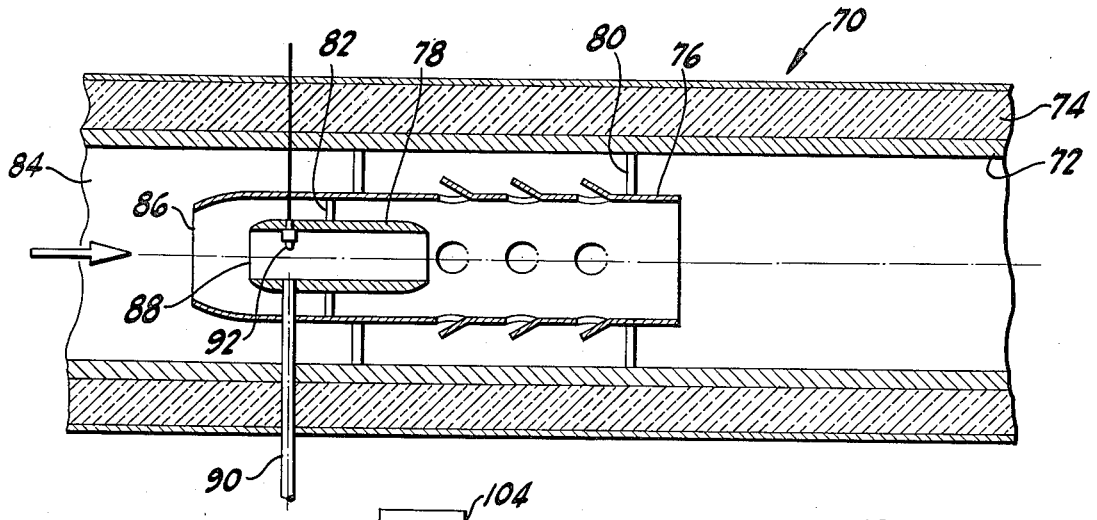
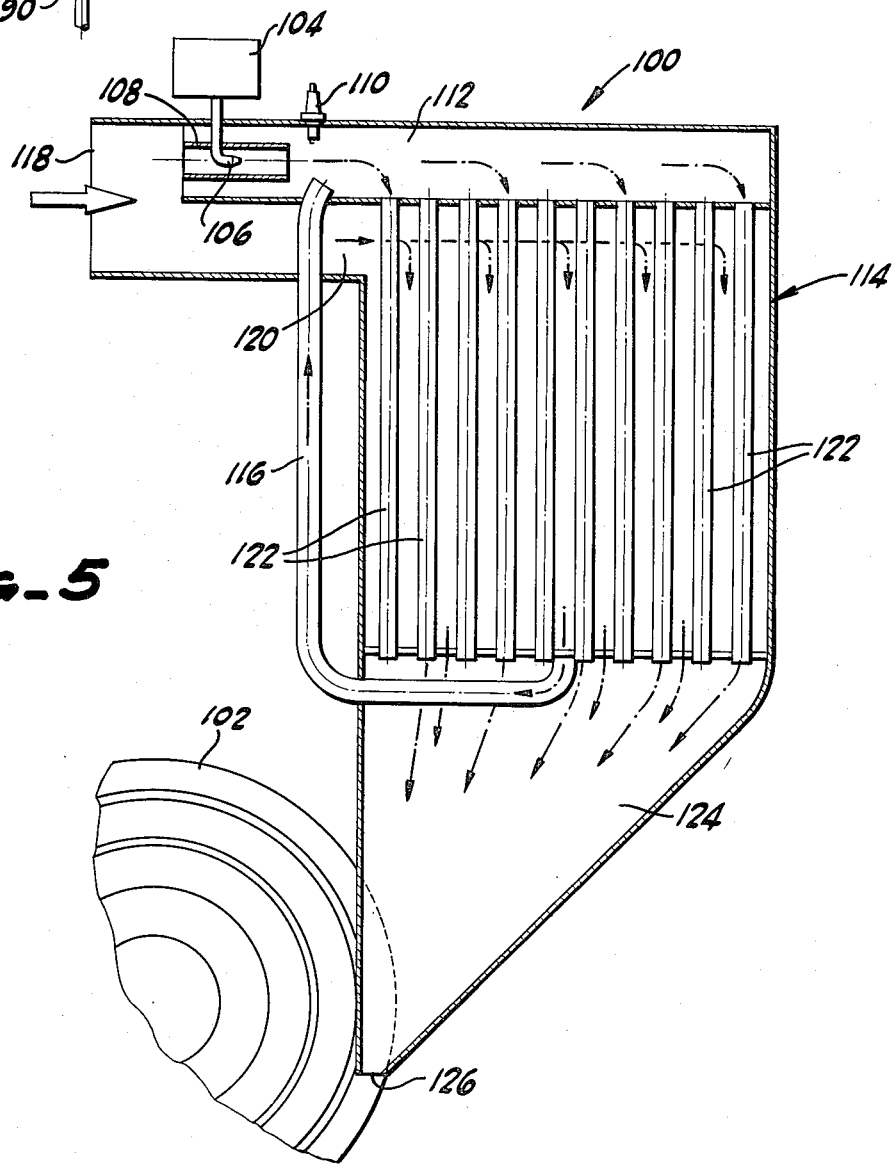
FIG-5

THREE-STAGE LIQUID FUEL BURNER

BACKGROUND OF THE INVENTION

This invention relates to a combustion burner that is designed to reduce polluting emittance particularly of the nitrogen compound materials generated during combustion processes in air at temperatures exceeding 2600 F. The burner of this invention is a three-stage liquid fuel burner that is designed for inclusion in low temperature and low pressure power systems such as turbine engines, specially designed piston engines and rotary engines. The liquid fuel burner is designed to operate with a fuel having a liquid consistency. However, the burner is operable with any fuel having a fluid type consistency including combustible gases and combustible powders.

The primary object of this invention is to construct a device that will efficiently combust liquid fuels without producing pollutants such as incompletely combusted particles and obnoxious gases such as carbon monoxide and without the production of the nitrogen compounds particularly the various compounds of nitrogen and oxygen. The combustor is also designed to generate a controlled temperature gas for utilization in an associated engine. While it is most conventional to utilize such combusted gases for the powering of a turbine engine, the combusted gases can be used to drive a piston engine of the type disclosed in my patent application entitled Pre-combustion Piston Engine. The general design of the combustor can be utilized with other systems for complete combustion of gases with certain modifications in overall design of the particular system involved.

SUMMARY OF THE INVENTION

The three-stage liquid fuel burner of this invention is preferably constructed in an elongated tubular fashion. Each of the three stages are combustion chambers formed by concentric cylindrical housings of increasing diameters in staggered lengths arranged concentrically and supplied by a common air source. Fuel is supplied to the innermost housing along with a controlled supply of air insufficient for complete combustion. The partially combusted gases are emitted to a second cylindrical housing concentrically arranged around and extending beyond the end of the first housing. The air is similarly introduced into the chamber formed by the second cylindrical housing for nearly complete combustion of the gases. The outermost or third cylindrical housing is again arranged concentrically around the two inner housings and extends beyond the end of the second or inner housing. The air is supplied to this chamber formed by this housing in excess of that necessary for stoichiometric combustion such that all of the fuel and derivative gases during combustion such as carbon monoxide are fully combusted. Combustion in the longitudinal chambers formed by the concentric cylindrical housings is such that a temperature less than 2500 F. is achieved. By this low temperature and gradual combustion, the nitrogen fixation process is inhibited and substantially eliminated.

These and other features of the invention are described in greater detail hereafter.

BRIEF DESCRIPTION OF THE DRAWINGS

FIG. 4 is a cross-sectional schematic view of an alternate embodiment of the fuel burner.

FIG. 5 is a schematic view of a further alternate embodiment of the fuel burner and auxiliary components.

DETAILED DESCRIPTION OF THE PREFERRED EMBODIMENT

Figure 1:
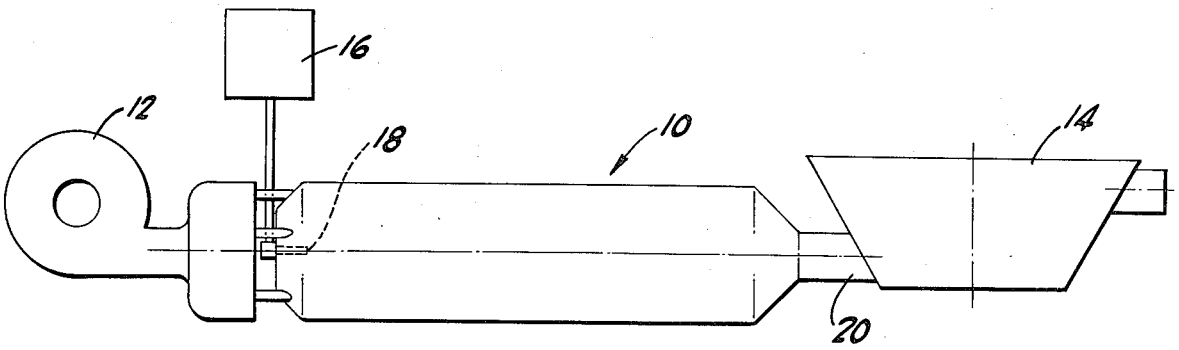
FIG. 1 is a schematic view of the fuel burner and auxiliary components.

Referring now to FIG. 1, the liquid fuel burner designated generally by reference 10 is schematically illustrated connected to an air compressor 12 or turbocharger at one end and a turbine 14 at the other end. Fuel is delivered to the liquid fuel burner from a fuel supply 16 to a fuel nozzle 18 in the burner. Essentially air is delivered to the fuel burner by air compressor 12, mixed with fuel from the fuel supply within the burner wherein hot exhaust gases under pressure are generated which gases are delivered to turbine 14 for the operation and powering of the turbine.

As noted it is the principal object of this invention to create a liquid fuel burner that will thoroughly combust the fuel without the generation of polluting nitrogen compounds. This is accomplished by the progressive combustion of the fuel in the elongated tubular fuel burner 10. In the presently preferred operation, combustion is accomplished in three stages. Each stage blends gradually into the other stage but may be considered for purposes of explanation as a first chamber, a second chamber, and a third chamber. This is convenient since the stages are reasonably defined by separate housings for each stage. In the first stage 100 percent of the fuel is injected along with a supply of air of approximately 70 percent of stoichiometric combustion. The products of this partial combustion are exhausted into the second stage wherein secondary air of about 40 percent of stoichiometric is mixed with the exhausted products to nearly complete combustion. The products of this stage are exhausted to a third stage wherein tertiary air of about 40 percent stoichiometric is added bringing the total air flow to approximately 150 percent stoichiometric. In the tertiary stage any incompletely combusted products are fully mixed with the surplus air and finally combusted. The three stages are contiguously arranged such that the products of combustion flow naturally from one stage to another with a gradual expansion in volume. As shown in FIG. 1, the partially expanded gases are delivered through a nozzle 20 at the end of the burner to the turbine 14.

Figure 2:
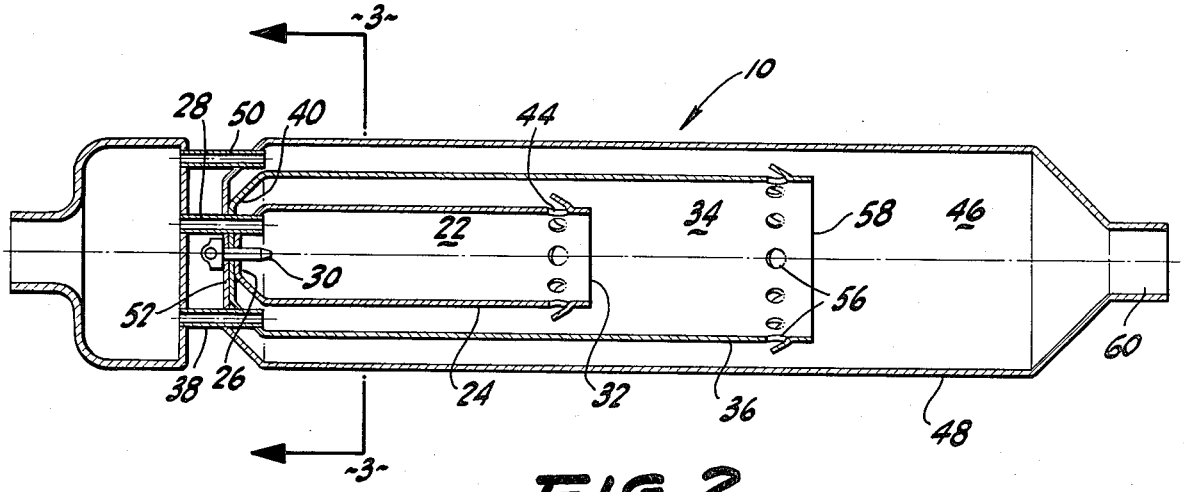
FIG. 2 is a cross-sectional view of the burner of FIG. 1.

Referring now to FIG. 2 in which a detailed illustration of the three-stage liquid fuel burner 10 is shown, the three stages are readily apparent.

Figure 3:
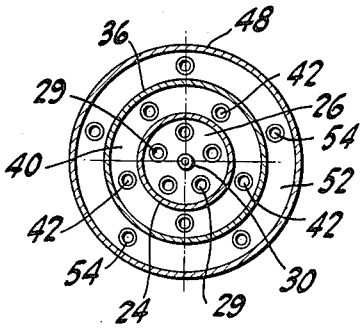
FIG. 3 is a cross-sectional view of the burner taken on the lines 3—3 in FIG. 2.

The first stage is defined generally by combustion chamber 22 formed by a cylindrical housing 24. The housing 24 has a lead end 26 with a plurality of air supply conduits 28 connected to the closed lead end of the housing. As shown in FIG. 3, the connection of the conduits to the lead end of the housing provides a series of air ports 29 in end of the configuration.

Centrally located at the closed lead end of the inner most housing 24 is a fuel supply nozzle 30 which provides a fine spray of fuel into the chamber 22. The fuel supply nozzle 30 includes an integral glow plug (not visible) for an initial ignition of the fuel in the chamber 22. Fuel is partially combusted along the length of the innermost chamber 22 of the first stage and is exhausted through the open end of the housing 24.

The gases emitted from the innermost chamber enter a second chamber 34 defined by elongated cylindrical housing 36 mounted concentrically around and extending beyond the inner housing 24. Air from a second set conduits 38 enter the closed end 40 of housing 36 through ports 42. A portion of the entering air is drawn into louvered ports 44 circumferentially around the open end 32 of the innermost housing 24. This air mixes with the exhausting air from the innermost chamber 22 improving combustion and creating a turbulance effect to expand the air to the full diameter of the secondary chamber 34 formed by the centrally located housing 36. This mix of air further functions to chill the products of combustion to maintain the temperature of the combustion reaction below 2600° F.

From the secondary stage the nearly complete products of combustion enter a tertiary or third stage in chamber 46 defined by the outer housing 48 of the liquid fuel burner. The air is again admitted through conduits 50 arranged around the periphery of the closed end 52 of the outer housing 48. The air enters through ports 54 and flows to the combustion chamber 46 to mix with the products of combustion from the secondary stage and second chamber 34. Again a portion of the air enters louvered ports 56 around the periphery of the open end 58 of the central housing 36 to mix and expand the products of combustion from the second stage into the full diameter of the third chamber 46 defined by the outer housing 48. The combustion gases are exhausted and accelerated through the nozzle 60 at the end of the burner.

The elongated tubular construction of the three-stage burner accomplishes two principal purposes. First, as mentioned, it divides the combustion of the fuel into three contiguous stages to greatly prolong the process of combustion without inhibiting the flow of combusted products toward the power plant, here the turbine 14. Second, the concentric arrangement of the housings defining generally the combustion chambers allows the air to be delivered to the two outer chambers to pass along the walls of the housing defining the inner chambers. In this manner the air is preheated to improve the mixing and combustion of the gases in the respective chambers, and the combustion within the inner chambers is consequently cooled to some extent by the air.

Referring to FIG. 4 a modified embodiment of a three-stage liquid fuel burner, designated generally by the reference 70, is shown. The burner 70 is constructed with a continuous outer housing 72 of constant diameter having an outer insulation casing 74 to retain the heat of combustion products within the burner for eventual delivery to an auxiliary power component (not shown). A central housing 76 and an innermost housing 78 are concentrically supported within the outer housing by splines 80 and 82. Air enters the open end 84 of the outer housing and is divided by the open end 86 and 88 of the central housing 76 and inner housing 78, respectively. The divided air flows through each of the respective housings and mixes first with fuel from a fuel supply line 90 ignited initially by glow plug 92 for partial combustion wihtin the inner housing 78. Products of partial combustion enter the central housing 76 where they are mixed with additional air and further combusted until emitted into the full diameter of the outer housing 72. In the outer housing the products are fully combusted before passing along the outer housing to an auxiliary device.

The primary difference of the embodiment of FIG. 4 from the embodiment of FIGS. 1 through 3 is in the manner of mixing and introducing air to the respective housings that define the chambers for combustion. The embodiment of FIGS. 1 through 3 is of greater efficiency because the feed ports for the air can be selected in size and arrangement to accurately tune the air admission to the optimum burning process for the particular fuel being consumed.

In both embodiments once combustion has been initiated by the glow plug, the process is continuous until the fuel supply is terminated.

Referring now to FIG. 5, a schematic illustration of a modified embodiment is shown. The three stages of combustion are somewhat differently oriented from the strict concentric arrangement of the prior embodiments. As shown in FIG. 5 the burner designated generally by the reference 100 is illustrated in conjunction with a turbine 102. Fuel from a fuel supply 104 is atomized at atomizer nozzle 106 in an inner chamber defined by housing 108. Combustion is initiated by a glow plug 110 as the atomized fuel enters the secondary chamber 112. The flame combustion leading from the atomizer nozzle 106 to the inner chamber 112 is mixed with preheated air from a heat exchanger 114 through feedback conduit 116.

Air from the air supply orifice 118 is divided for passage into the innermost housing 108, the secondary chamber 112 and through a passage 120 and enters the heat exchanger 114. The heat exchanger is contructed with a plurality of tubes 122 through which the product of partial combustion from the chamber 112 pass to the final chamber 124. Air from passage 120 passes through the heat exchanger 122 and is warmed before mixing with the partially combusted products from the chamber 112 in the final stage at chamber 124 where complete combustion is accomplished. The immediate delivery of the products of partial combustion to the heat exchanger prevents the temperature from exceeding the nitrogen fixation temperature by cooling the gases from the air flow over the tubes 122 before final mixture in the combustion chamber 124.

The tertiary combustion 124 constricts to a discharge orifice 126 for delivery of the combustion products to the turbine 102.

The three-stage liquid fuel burner as illustrated in FIG. 5 can be modified for operation with a particular type of engine. These modifications are necessary to extract the optimum efficiency from the basic concepts of the three-stage design.

While in the foregoing specification embodiments of the invention have been set forth in considerable detail for the purposes of making a complete disclosure of the invention, it will be apparent to those of ordinary skill in the art that numerous changes may be made in such details without departing from the spirit and principals of the invention.

What is claimed is:

1. A three stage combustion device wherein the temperature of combustion is maintained at a level that inhibits nitrogen fixation comprising:

(a) an air delivery means for continuously delivering a defined flow of air to said combustion device;

(b) a fuel delivery means for delivering a continuous supply of fuel to said combustion device;

(c) a first combustion stage wherein said fuel delivery means includes means for emitting fuel into said first combustion stage and wherein said air delivery means includes means for delivering a portion of the defined flow of air, less than the stoichiometric requirements of the delivered fuel, to said first combustion stage;

(d) means for igniting fuel delivered to said first combustion stage wherein ignited fuel is partially combusted products of partial combustion;

(e) a second combustion stage communicating with said first combustion stage wherein the products of partial combustion are emitted to said second combustion stage and wherein said air delivery means includes means for delivering an additional portion of the defined flow of air to said second stage, which in combination with the portion of air delivered to said first stage approximates the stoichiometric requirements of the delivered fuel for substantial combustion producing products of substantial combustion; and (f) a third combustion stage communicating with said second combustion stage wherein the products of substantial combustion are emitted to said third combustion stage and wherein said air delivery means includes means for delivering an additional portion of the defined flow of air to said third stage, to which in combination with the portions of air delivered to said first and second stages exceeds the stoichiometric requirements of the delivered fuel, for substantially complete combustion producing products of substantially complete combustion.

2. The combustion device of claim 1 wherein said air delivery means includes means for preheating the portion of air delivered to said second stage.

3. The combustion device of claim 1 wherein said air delivery means includes means for preheating the portion of air delivered to said third stage.

4. The combustion device of claim 1 wherein said first combustion stage comprises a housing defining a combustion chamber, said air delivery means and said fuel delivery means arranged with respect to said housing to deliver air and fuel into said housing.

5. The combustion device of claim 4 wherein said second combustion stage comprises a second housing defining a second combustion chamber, said housing of said first combustion stage having an opening communicating with the second combustion chamber.

6. The combustion device of claim 5 wherein said third combustion stage comprises a third housing defining a third combustion chamber, said housing of said second combustion chamber having an opening communicating with the third combustion chamber.

7. The combustion device of calim 6 wherein said combustion chamber of said first stage and said second and third combustion chambers are progressively larger in volume.

8. The combustion device of claim 6 wherein said housing of said first stage is cylindrical in configuration with at least one open end; said second housing is cylindrical in configuration having at least one open end, substantially larger in diameter and longer in length than said housing of said first stage, and is arragned concentrically about said housing of said first stage, and said third housing is cylindrical in configuration having a discharge end, substantially larger diameter and longer in length than said second housing and is arranged concentrically about said second housing.

9. The combustion device of claim 8 wherein said ends of said housing opposite said open ends and discharge end are substantially closed and said air delivery means includes a substantially common wall with a plurality of intake ports for admission of air into said housing.

10. The combustion device of claim 8 wherein said ends of said housings opposite said open ends and discharge end are substantially open and said air delivery means includes an air conduit connected in common to said substantially open end.

* * * * *